US011331636B2

(12) United States Patent
Soliman et al.

(10) Patent No.: US 11,331,636 B2
(45) Date of Patent: May 17, 2022

(54) MULTI-OPENING CHEMICAL INJECTION DEVICE

(71) Applicant: Saudi Arabian Oil Company, Dhahran (SA)

(72) Inventors: Mohamed Ahmed Soliman, Ras Tanura (SA); Samer Osamah Abduljabbar, Al Khobar (SA); Samusideen Adewale Salu, Ras Tanura (SA)

(73) Assignee: Saudi Arabian Oil Company, Dhahran (SA)

( * ) Notice: Subject to any disclaimer, the term of this patent is extended or adjusted under 35 U.S.C. 154(b) by 49 days.

(21) Appl. No.: 16/941,726

(22) Filed: Jul. 29, 2020

(65) Prior Publication Data

US 2022/0032242 A1 Feb. 3, 2022

(51) Int. Cl.
*B01F 25/312* (2022.01)
*B01F 25/00* (2022.01)

(52) U.S. Cl.
CPC .. *B01F 25/31242* (2022.01); *B01F 25/31232* (2022.01); *B01F 25/312532* (2022.01); *B01F 2025/916* (2022.01); *B01F 2025/917* (2022.01)

(58) Field of Classification Search
CPC .. B01F 5/0062; B01F 3/04503; B01F 5/0428; B01F 5/048; B01F 2005/0045; B01F 2005/0014; B01F 2005/0017; B01F 5/0421; B01F 2005/0025; B01F 2005/0028; B01F 2005/0446; B01F 2005/0443; B01F 2005/0445; B01F 2005/0448; B01F 2005/0431; B01F 25/31242; B01F 25/31232; B01F 25/312532; B01F 2025/916; B01F 2025/917; B01F 2101/2204; B01F 25/312531; B01F 23/451
USPC ..... 366/163.2
See application file for complete search history.

(56) References Cited

U.S. PATENT DOCUMENTS

| | | | | |
|---|---|---|---|---|
| 4,436,113 | A * | 3/1984 | Finger | B01F 5/0413 134/100.1 |
| 4,747,426 | A | 5/1988 | Weevers | |
| 6,601,832 | B1 | 8/2003 | Palmu | |
| 7,137,569 | B1 | 11/2006 | Miller et al. | |
| 7,416,326 | B2 * | 8/2008 | Sakata | A61L 2/18 366/163.2 |
| 9,295,953 | B2 | 3/2016 | Linga et al. | |

(Continued)

FOREIGN PATENT DOCUMENTS

| | | |
|---|---|---|
| EP | 1 294 473 B1 | 2/2006 |
| EP | 3 462 271 A1 | 4/2019 |
| GB | 2 311 333 A | 9/1997 |

OTHER PUBLICATIONS

International Search Report for PCT/IB2020/057540, 6 pages (dated Apr. 15, 2021).

(Continued)

*Primary Examiner* — Charles Cooley
(74) *Attorney, Agent, or Firm* — Choate, Hall & Stewart LLP; Charles E. Lyon; Peter A Flynn

(57) ABSTRACT

A fluid mixing device includes a plurality of nozzles, each having a converging chamber, at least one chemical injection port, a diverging chamber, a nozzle throat, and an adjustable self-opening valve. The fluid mixing device provides for improvements in mixing fluids.

20 Claims, 6 Drawing Sheets

(56) References Cited

U.S. PATENT DOCUMENTS

| | | | | |
|---|---|---|---|---|
| 10,258,942 | B2 | 4/2019 | Kenreck, Jr. et al. | |
| 10,266,436 | B2 | 4/2019 | Whitmore, Sr. et al. | |
| 2012/0234420 | A1* | 9/2012 | Matsukawa | F22B 37/02 137/895 |
| 2015/0375182 | A1* | 12/2015 | Travis, II | B01F 13/0027 366/337 |
| 2018/0058388 | A1 | 3/2018 | Zhang | |
| 2018/0119831 | A1 | 5/2018 | Suzuki et al. | |
| 2020/0108358 | A1 | 4/2020 | Sabey et al. | |
| 2022/0032242 | A1* | 2/2022 | Soliman | B01F 25/312531 |

OTHER PUBLICATIONS

Written Opinion for PCT/IB2020/57540, 8 pages (dated Apr. 15, 2021).

* cited by examiner

MULTI-OPENING CHEMICAL INJECTION DEVICE

TECHNICAL FIELD

This application relates to tools and related devices, systems and methods for mixing fluids.

BACKGROUND

During the production, handling, and transportation of crude oil, the addition of various types of chemicals to the oil may be required. For example, as crude oil produced from wells typically includes a mixture of gas, liquid hydrocarbons, and salty formation water, which can cause corrosion in the piping or may have detrimental scaling effects on processing units and on catalysts, chemicals for controlling such issues are necessary. Additionally, chemicals may be needed during the transportation and logistical handling of the crude oil, for example, in a pipeline, tanker, or terminal to improve fluid properties for conveying the oil. Chemicals can also prevent or mitigate other problems that might negatively affect the production flow and/or process completion (for example, reduction or elimination of undesirable fluid components). Oil producers typically inject chemicals into the production stream to mitigate such problems. For such chemical injections, uniform mixing of chemicals and the process fluid is required to increase the effectiveness of the treatment chemical and reduce operating costs.

SUMMARY

Conventional methods/systems for injecting chemicals involve an injection quill along with a mixing valve (for example, a globe valve) or a static mixer (for example, a Sulzer static mixer). These conventional methods and systems, however, do not guarantee sufficient mixing efficiency. Mixing efficiency may be defined as the ratio of the net change in potential energy due to mixing to the energy expended in producing the mixing. Deficient mixing of the chemical and the process streams (oil streams) may result in one or more of equipment failure, operation interruption, high operating cost due to increased chemical consumption, and equipment corrosion. Therefore, improved approaches that can replace existing valves/mixers relatively easily are both desirable and needed.

The present disclosure relates to devices, systems, and methods for mixing a fluid, for example, oil, and an added chemical therein.

A fluid mixing device includes a plurality of nozzles connected to an inlet port for receiving a fluid and directing the fluid to the plurality of nozzles and connected to an outlet port. Each of the plurality of nozzles has a longitudinal axis substantially parallel to a main direction of fluid flow. Each of the plurality of nozzles includes a converging chamber having an inflow portion for receiving fluid from the inlet port and an outflow portion. A diameter of the inflow portion is greater than a diameter of the outflow portion. Each of the plurality of nozzles includes a chemical injection port connected to the outflow portion of the converging chamber and adapted for delivering a chemical agent to the converging chamber. Each of the plurality of nozzles includes a diverging chamber having an inflow portion and an outflow portion. A diameter of the inflow portion of the diverging chamber is smaller than a diameter of an outflow portion of the diverging chamber. Each of the plurality of nozzles includes a nozzle throat in fluid connection with the outflow portion of the converging chamber and the inflow portion of diverging chamber. The nozzle throat has a diameter that is smaller than any other portion of the nozzle. Each of the plurality of nozzles includes an adjustable self-opening valve disposed in the diverging chamber and adapted such that when a pressure across a surface of the adjustable self-opening valve substantially perpendicular to each axis is higher than a predetermined value, the adjustable self-opening valve opens. Each of the plurality of nozzles is adapted such that flowing the fluid through the mixing device produces a homogenous mixture of the fluid and the chemical agent in the diverging chamber.

The adjustable self-opening valve may include a spring. The fluid mixing device may include two, three, four, five, six, seven, eight, nine, or ten nozzles.

The fluid may be crude oil, water, gas, formation fluids, or glycol, or any combination thereof. The chemical agent may be a demulsifier, scale inhibitor, corrosion inhibitor, oxygen scavenger, biocide, antifoaming agent, drag reducing agent, hydrate inhibitor, hydrogen sulfide scavenger, mercaptan scavenger, paraffin control agent, pour point depressant, or asphaltene control agent, or any combinations thereof.

The adjustable self-opening valve may not include an external control mechanism. A pressure differential along the longitudinal axis of the converging chamber may be within a range of 3 kPa to 700 kPa. A pressure differential along the longitudinal axis of the diverging chamber may be within a range of 3 kPa to 700 kPa. The converging chamber may be adapted to increase a velocity of the fluid. The diverging chamber may be adapted to decrease the velocity of the fluid. The predetermined value may be within a range of 1.0 kPa to 100 kPa.

The axes of the plurality of nozzles may be parallel to each other. The plurality of the nozzles may be radially off-set about a longitudinal axis of the device at a regular angular interval. The regular angular interval may be about 15, 30, 45, 60, 90, 120, 135, 150, or 180 degrees. The plurality of the nozzles may be randomly distributed within the fluid mixing device across a plane perpendicular to the axes. The chemical injection ports of each of the plurality of the nozzles may be fluidly connected to a chemical agent tank.

The fluid flow in the converging chamber may be turbulent. The fluid flow in the converging chamber may be laminar. The fluid may be incompressible. A flow rate at the output port may be substantially constant when the adjustable self-opening valves are open.

Definitions

In order for the present disclosure to be more readily understood, certain terms are first defined below. Additional definitions for the following terms and other terms are set forth throughout the specification.

In this application, unless otherwise clear from context, the term "a" may be understood to mean "at least one." As used in this application, the term "or" may be understood to mean "and/or." In this application, the terms "comprising" and "including" may be understood to encompass itemized components or steps whether presented by themselves or together with one or more additional components or steps. As used in this application, the term "comprise" and variations of the term, such as "comprising" and "comprises," are not intended to exclude other additives, components, integers or steps.

About, Approximately: as used herein, the terms "about" and "approximately" are used as equivalents. Unless otherwise stated, the terms "about" and "approximately" may be understood to permit standard variation as would be understood by those of ordinary skill in the art. Where ranges are provided herein, the endpoints are included. Any numerals used in this application with or without about/approximately are meant to cover any normal fluctuations appreciated by one of ordinary skill in the relevant art. In some embodiments, the term "approximately" or "about" refers to a range of values that fall within 25%, 20%, 19%, 18%, 17%, 16%, 15%, 14%, 13%, 12%, 11%, 10%, 9%, 8%, 7%, 6%, 5%, 4%, 3%, 2%, 1%, or less in either direction (greater than or less than) of the stated reference value unless otherwise stated or otherwise evident from the context (except where such number would exceed 100% of a possible value).

Substantially: As used herein, the term "substantially" refers to the qualitative condition of exhibiting total or near-total extent or degree of a characteristic or property of interest.

These and other objects, along with advantages and features of the disclosed systems and methods, will become apparent through reference to the following description and the accompanying drawings. Furthermore, it is to be understood that the features of the various embodiments described are not mutually exclusive and can exist in various combinations and permutations.

BRIEF DESCRIPTION OF THE DRAWINGS

In the drawings, like reference characters generally refer to the same parts throughout the different views. Also, the drawings are not necessarily to scale, emphasis instead generally being placed upon illustrating the principles of the disclosed systems and methods and are not intended as limiting. For purposes of clarity, not every component may be labeled in every drawing. In the following description, various embodiments are described with reference to the following drawings, in which.

DETAILED DESCRIPTION

The present disclosure describes devices, systems, and methods for mixing a fluid, for example, oil, and a chemical.

In gas oil separation plants, crude oil production platforms, and crude oil transmission pipelines, chemical, petrochemical and oil refineries, chemical are frequently injected into process streams, for example, to reduce or remove some or all undesirable components or to neutralize them. Efficient uniform mixing of the chemical into the process fluid may increase the effectiveness of the treatment chemical and reduce operating cost costs. For many injection applications, an injection quill is used to inject the chemical into the process stream but high mixing efficiency or efficacy is not guaranteed, for example, due to the smooth or laminar flow patterns in the fluid conduit. Moreover, a static setup, for example, a quill and a static mixer, may work efficiently only under certain, narrowly defined flow conditions. An adjustable system as described in this specification may improve mixing across a broader range of fluid flow conditions.

Figure 1:
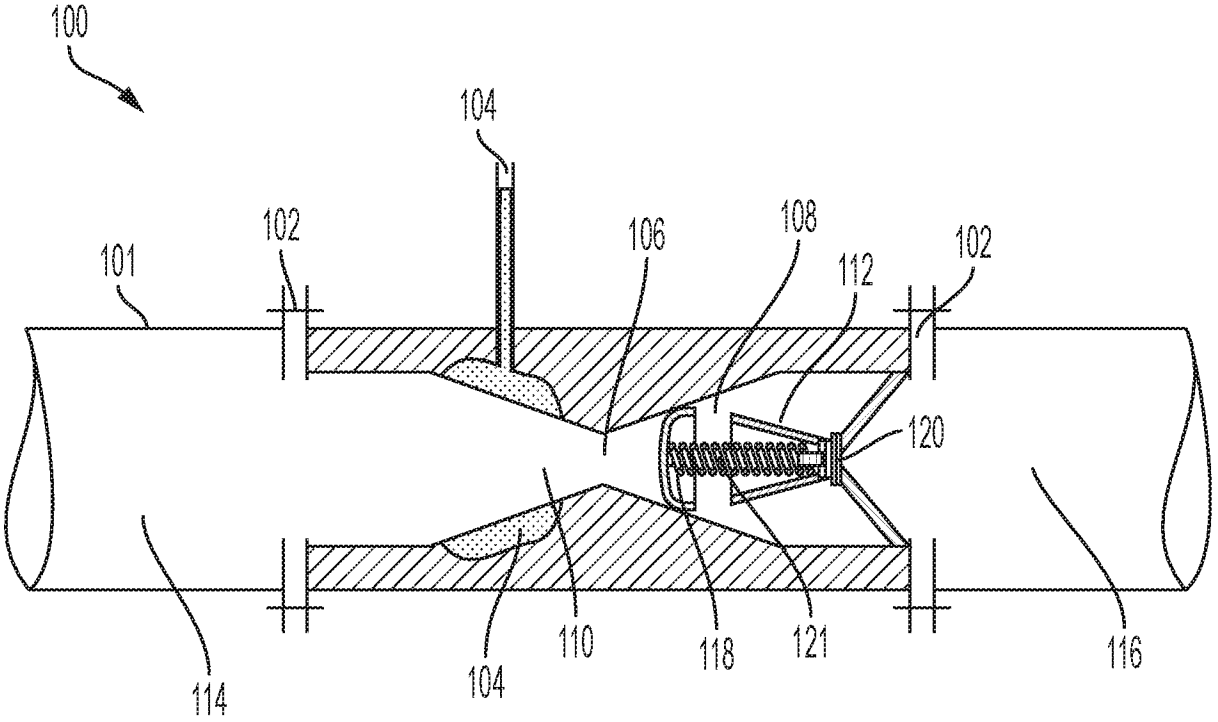
FIG. 1 is a schematic representation of a fluid mixing device comprising a single nozzle with an adjustable valve in a closed position in accordance with one or more embodiments.

FIG. 1 depicts an example nozzle 100 for mixing a fluid, for example, a liquid or a multiphase fluid, and an injected chemical substance. The injected chemical substance may be or include a liquid, a solid, a gas, or a combination of two or more of a liquid, a solid, a gas.

The nozzle 100 has a longitudinal axis that is substantially parallel to the main direction of fluid flow. The nozzle includes a converging chamber 110 for receiving the fluid from an inlet port 114 and a diverging chamber 108 for directing the fluid to an outlet port 116. The converging chamber 110 and the diverging chambers 108 are connected via a nozzle throat 106, which constitutes the section with the smallest diameter within the nozzle 100. The converging chamber 110 may have a substantially circular cross-section perpendicular to the longitudinal axis. The diameter of converging chamber 110 decreases in the direction of the fluid flow, so that the diameter of the converging chamber 110 at an outflow portion is smaller than the diameter at an inflow portion of the converging chamber 110. In some embodiments, the converging chamber 110 has a substantially frusto-conical shape. In some embodiments, the converging chamber 110 is adapted to increase a velocity of the fluid. In some embodiments, the converging chamber 110 is adapted to increase a velocity of the fluid and to cause turbulent mixing. The nozzle 100 is connected to a conduit or pipe 101 via one or more flanges 102.

The diverging chamber 108 may have a substantially circular cross-section perpendicular to the longitudinal axis. The diameter of the diverging chamber 108 increases in the direction of the fluid flow, so that the diameter of the diverging chamber 108 at an outflow portion is larger than the diameter at an inflow portion of the diverging chamber 108. In some embodiments, the diverging chamber 108 has a substantially frusto-conical shape. In some embodiments, the diverging chamber 108 is adapted to decrease the velocity of the fluid. In some embodiments, the fluid recovers the pressure in the diverging chamber 108 and reduces the pressure drop between inlet port 114 and outlet port 116 of the nozzle 100.

A chemical injection port 104 is fluidly connected to the outflow portion of the converging chamber 110. The chemical injection port 104 is in fluid connection with a chemical agent tank and may be used to convey the chemical agent from the tank to the nozzle 100, for example, the converging chamber 110. In some embodiments, the nozzle 100 may include more than one chemical injection port 104, for example, to add more than one chemical agents that cannot be exposed to each other prior to the mixing. In some embodiments, the nozzle 100 may include more than one chemical injection ports 104, for example, to increase a total flow rate of the chemical agent to the nozzle 100. In some embodiments, the nozzle 100 may include more than one chemical injection ports 104, for example, a first chemical injection port 104 for injecting a first chemical agent and a second chemical injection port 104 for injecting a second chemical agent. In some embodiments, the chemical injection port 104 is adapted to provide the chemical agent evenly over the cross-sectional area of the converging chamber 110, yielding uniform injection. In some embodiments, a chemical injection port 104 may include a valve, a nozzle, a perforated tube, a needle, or a combination of a valve, a nozzle, a perforated tube, and a needle.

An adjustable self-opening valve is disposed in the diverging chamber 108. The adjustable self-opening valve 112 is adapted such that when a pressure across a surface of the adjustable self-opening valve 112 substantially perpendicular to a longitudinal axis (for example, substantially parallel to a main direction of fluid flow) is higher than a predetermined value, the adjustable self-opening valve 112 opens. In some embodiments, the predetermined value is between 0.1 kilopascals (kPa) and 1,000 kPa. In some embodiments, the predetermined value is between 1.0 kPa and 100 kPa. In some embodiments, a valve may include a valve body 120 and a tip section 118. In some embodiments, the valve body 120 may be stationary relative to the nozzle and the tip section 118 may be moveable. In some embodiments, the adjustable self-opening valve 112 may include an internal control mechanism 121, for example, a mechanism including an elastic material (for example, a spring, an elastomer, or a diaphragm). In some embodiments, the internal control mechanism 121 is connected to the tip section 118 and the valve body 120 and may be used to control the movement of the tip section 118 relative to the valve body 120. In some embodiments, the adjustable self-opening valve 112 may be adapted such that when a pressure across a surface of the tip section 118 (for example, substantially parallel to a main direction of fluid flow) is lower than a predetermined value, tip section 118 remains in contact with a wall of diverging section 108 such that the nozzle is substantially closed. In some embodiments, the adjustable self-opening valve 112 may be adapted such that when a pressure across a surface of the tip section 118 (for example, substantially parallel to a main direction of fluid flow) is higher than a predetermined value, tip section 118 is moved in a downstream direction and the adjustable self-opening valve opens. In some embodiments, the adjustable self-opening valve 112 may be adapted such that when a pressure across a surface of the tip section 118 (for example, substantially parallel to a main direction of fluid flow) increases, tip section 118 is moved in a downstream direction and the adjustable self-opening valve opens further. In some embodiments, the adjustable self-opening valve 112 does not include an external control mechanism, for example, a mechanism that would allow the opening to be controlled by an operator external to the nozzle 100.

Figure 2:
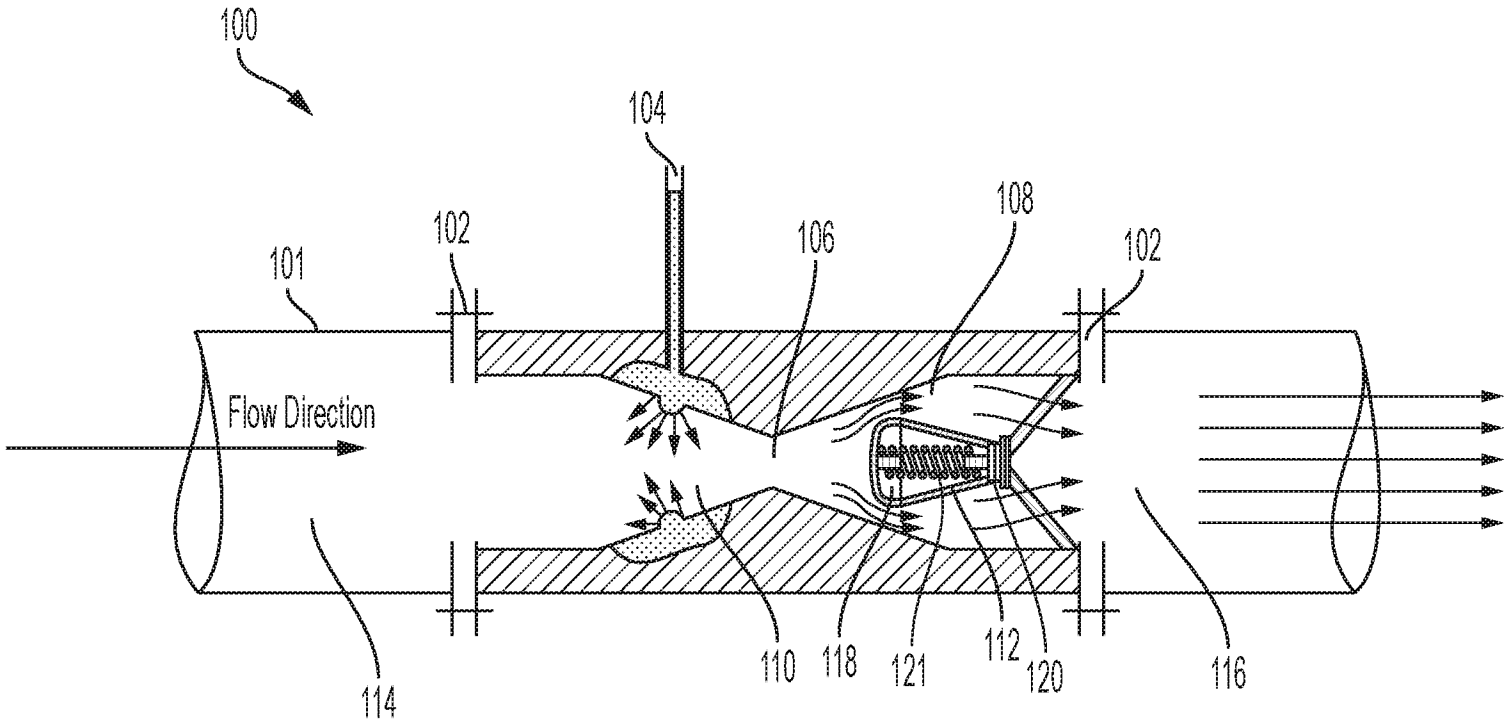
FIG. 2 is a schematic representation of a fluid mixing device comprising a single nozzle with an adjustable valve in an open position in accordance with one or more embodiments.

FIG. 1 shows the adjustable self-opening valve 112 in a closed position, as the pressure across the surface of the adjustable self-opening valve 112 is not high enough to cause opening of the valve 100. FIG. 2 shows that the adjustable self-opening valve 112 in an open position, and the fluid flows through the nozzle 100. In some embodiments, the adjustable self-opening valve 112 may open partially and may remain partially open at zero or atmospheric pressure. In some embodiments, a level or degree of opening of the adjustable self-opening valve 112 may depend on the pressure across the surface of the adjustable self-opening valve 112. In some embodiments the internal control mechanism may be adapted, so that a flow rate at the output port 116 remains substantially constant. For example, the adjustable self-opening valve 112 may open to a greater extent as the pressure across the tip section 118 increases. In some embodiments, when a chemical agent is injected into the main fluid flow, flowing the fluid through the mixing device produces a homogenous mixture of the fluid and the chemical agent in the diverging chamber 108.

Figure 3:
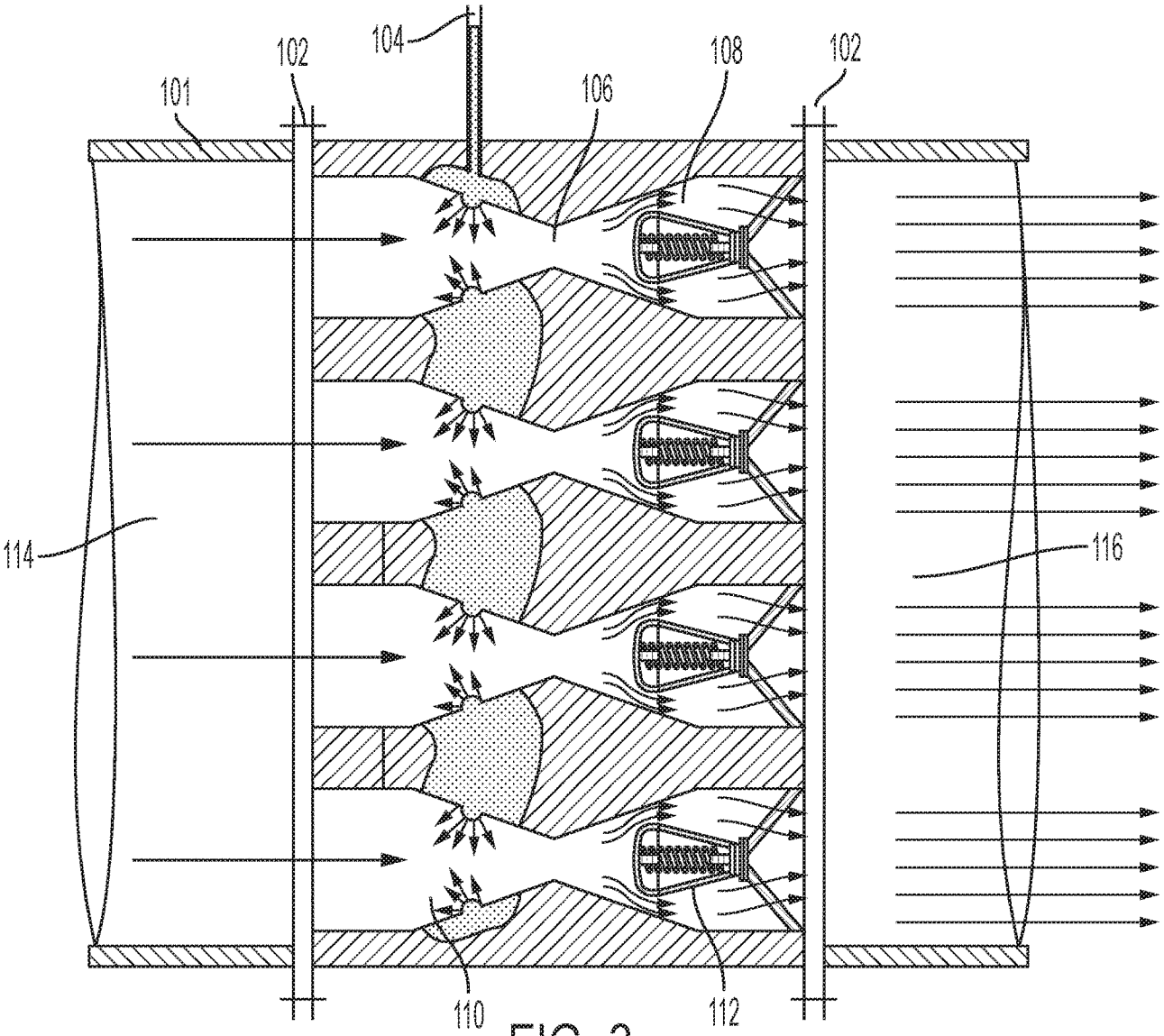
FIG. 3 is a schematic representation of a fluid mixing device comprising a plurality of nozzles with adjustable valves in an open position in accordance with one or more embodiments.
Figure 4:
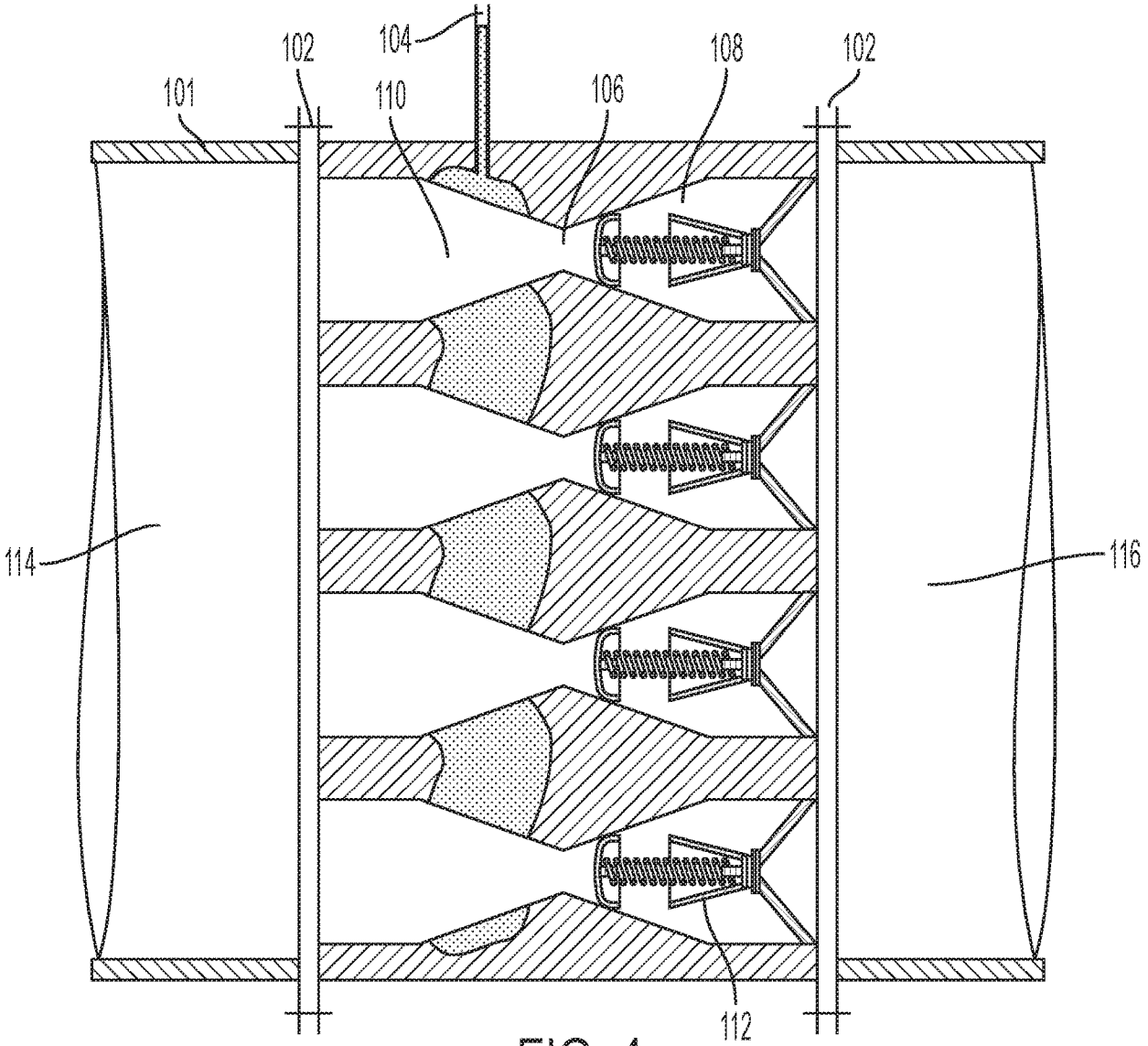
FIG. 4 is a schematic representation of a fluid mixing device comprising a plurality of nozzles with adjustable valves in a closed position in accordance with one or more embodiments.

In some embodiments, a fluid mixing device may include a plurality of nozzles 100 as shown in FIGS. 3 and 4. In such embodiments, the fluid mixing device may include two, three, four, five, six, seven, eight, nine, or ten nozzles.

In some embodiments, each of the plurality of nozzles 100 has a longitudinal axis substantially parallel to a main direction of fluid flow. In some embodiments, one inlet port 114 is connected to the plurality of nozzles 100 such that the flow is distributed between the individual nozzles 100. In some embodiments, one outlet port 116 is connected to the plurality of nozzles 100 such that the flow streams out of the individual nozzles 100 are joined. In some embodiments, the flow streams out of the individual nozzles 100 may be (further) mixed together, for example, using a static mixer. In some embodiments, the flow rates of the plurality of nozzles 100 are substantially similar to each other. In some embodiments, the flow rates of the plurality of nozzles are different from each other.

In some embodiments, a nozzle 100 may be fluidly connected to a single chemical injection port 104, as described supra. In some embodiments, a nozzle 100 may be connected to multiple injection ports 104. In some embodiments, multiple injection ports may be fluidly connected to the same chemical agent tank. In some embodiments, multiple injection ports may be fluidly connected to two or more chemical agent tanks.

In some embodiments, the fluid mixing device in accordance with the present disclosure is disposed between a pair of flanges inside a pipe.

In some embodiments, the fluid mixing device in accordance with the present disclosure provides high mixing efficiency, for example, mixing efficiency within a range of 0.1 to 1.0. In some embodiments, the fluid mixing device provides consistent mixing efficiency over wide range of flow conditions (for example, flow rates, pressures). In some embodiments, the fluid mixing device provides consistent mixing efficiency when a volumetric flow rate of the fluid is low: For example, a flow rate through the fluid mixing device may be between 75% and 100% of the design flow rate for the pipe or conduit. In some embodiments, a fluid mixing device in accordance with the present disclosure may achieve improved and more consistent mixing than existing devices at turndown ratios below 75% (turndown ratio=ratio of maximum capacity (flow rate) to minimum capacity (flow rate)). In some embodiments, a fluid mixing device in accordance with the present disclosure may achieve improved and more consistent mixing than existing devices at turndown ratios between 25% and 75%. In some embodiments, the fluid mixing device provides consistent mixing efficiency when a volumetric flow rate of the fluid is high. For example, a flow rate through the fluid mixing device may be between 25% and 100% of the design flow rate for the pipe or conduit. In some embodiments, the fluid mixing device provides consistent mixing efficiency when the volumetric flow rate of a liquid chemical agent is low, for example, less than 1.0%, less than 0.1%, less than 0.01%, less than 0.001%, or less than 0.0001% of the fluid flow through the fluid mixing device. In some embodiments, the fluid mixing device provides consistent mixing efficiency when the volumetric flow rate of a liquid chemical agent is high, for example, more than 1.0%, more than 5%, more than 10%, or more than 20% of the fluid flow through the fluid mixing device.

In some embodiments, the fluid is selected from the group consisting of crude oil, water, gas, formation fluids (for example, formation water), glycols for gas dehydration, and combinations thereof. In some embodiments, the fluid is incompressible. In some embodiments, the fluid is viscous, for example, the fluid a viscosity is between 1 and 30,000 miliPascal seconds (mPa·s) at 25° C. In some embodiments, the fluid viscosity is between 1 and 10,000 mPa·s. In some embodiments, the fluid viscosity is between 1 and 1,000 mPa·s. In some embodiments, the fluid viscosity is between 1 and 500 mPa·s. In some embodiments, the fluid viscosity is between 1 and 200 mPa·s. In some embodiments, the fluid viscosity is between 10 and 200 mPa·s.

In some embodiments, the chemical agent may be or may include a demulsifier, a scale inhibitor, a corrosion inhibitor, an oxygen scavenger, a biocide, an antifoaming agent, a drag reducing agent, a hydrate inhibitor, a hydrogen sulfide scavenger, a mercaptan scavenger, a paraffin control agent, a pour point depressant, an asphaltene control agent, or a combinations thereof.

In some embodiments, a ratio of volumetric flow rate of the fluid and the volumetric flow rate of a liquid chemical agent in the converging chamber 110 is between $10^{10}$:1 and 10:1. In some embodiments, the ratio is between $10^{9}$:1 and 10:1. In some embodiments, the ratio is between $10^{8}$:1 and 10:1. In some embodiments, the ratio is between $10^{7}$:1 and 10:1. In some embodiments, the ratio is between $10^{6}$:1 and 10:1. In some embodiments, the ratio is between $10^{5}$:1 and 10:1. In some embodiments, the ratio is between $10^{4}$:1 and 10:1. In some embodiments, the ratio is between 1000:1 and 10:1.

In some embodiments, a pressure drop across the converging chamber or diverging chamber may depend on the operating pressure in the pipe, the pipe dimensions, and the allowable pressure drop. In some embodiments, a pressure drop or pressure differential across or along the longitudinal axis of the converging chamber 110 is within a range of 1 kilopascals (kPa) to 1000 kPa or from 3 kilopascals (kPa) to 700 kPa. In some embodiments, a pressure drop or pressure differential across or along the longitudinal axis of the diverging chamber is within a range of 1 kilopascals (kPa) to 1000 kPa or from 3 kilopascals (kPa) to 700 kPa.

In some embodiments, a diameter of the inflow portion of the converging chamber 110 is between 0.1 and 10 m. In some embodiments, a length of the converging chamber 110 is between 0.1 and 10 m. In some embodiments, a diameter of the nozzle throat is between 0.01 and 1 m. In some embodiments, a diameter of the outflow portion of the diverging chamber 108 is between 0.1 and 10 m. In some embodiments, a length of the diverging chamber 108 is between 0.1 and 10 m.

In some embodiments, the plurality of the nozzles 100 are radially off-set about a longitudinal axis of the device at a regular angular interval. In some embodiments, the regular angular interval is about 15, 30, 45, 60, 90, 120, 135, 150, or 180 degrees. In some embodiments, the plurality of the nozzles 100 are randomly distributed within the fluid mixing device across a plane perpendicular to the axis. In some embodiments, a flow rate at the output port is substantially constant when the plurality of adjustable self-opening valves 112 are open.

Figure 5B:
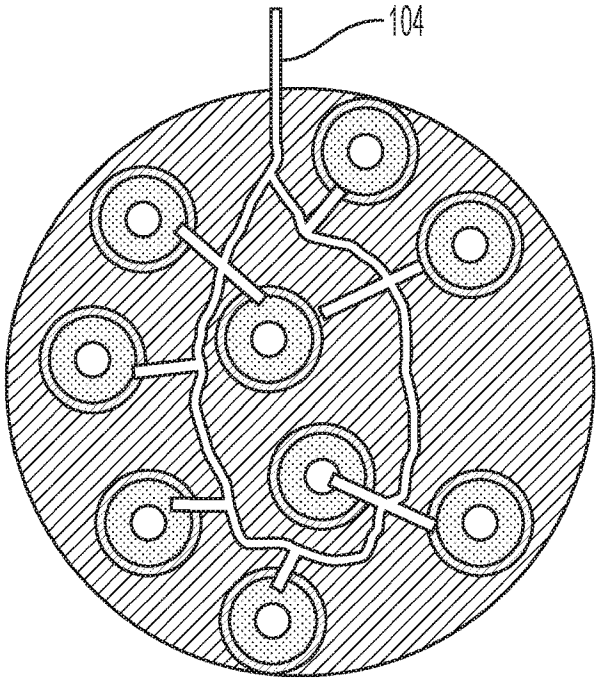
FIGS. 5A and 5B are schematic representations of a fluid mixing device comprising a plurality of nozzles without an adjustable valve.
Figure 5A:
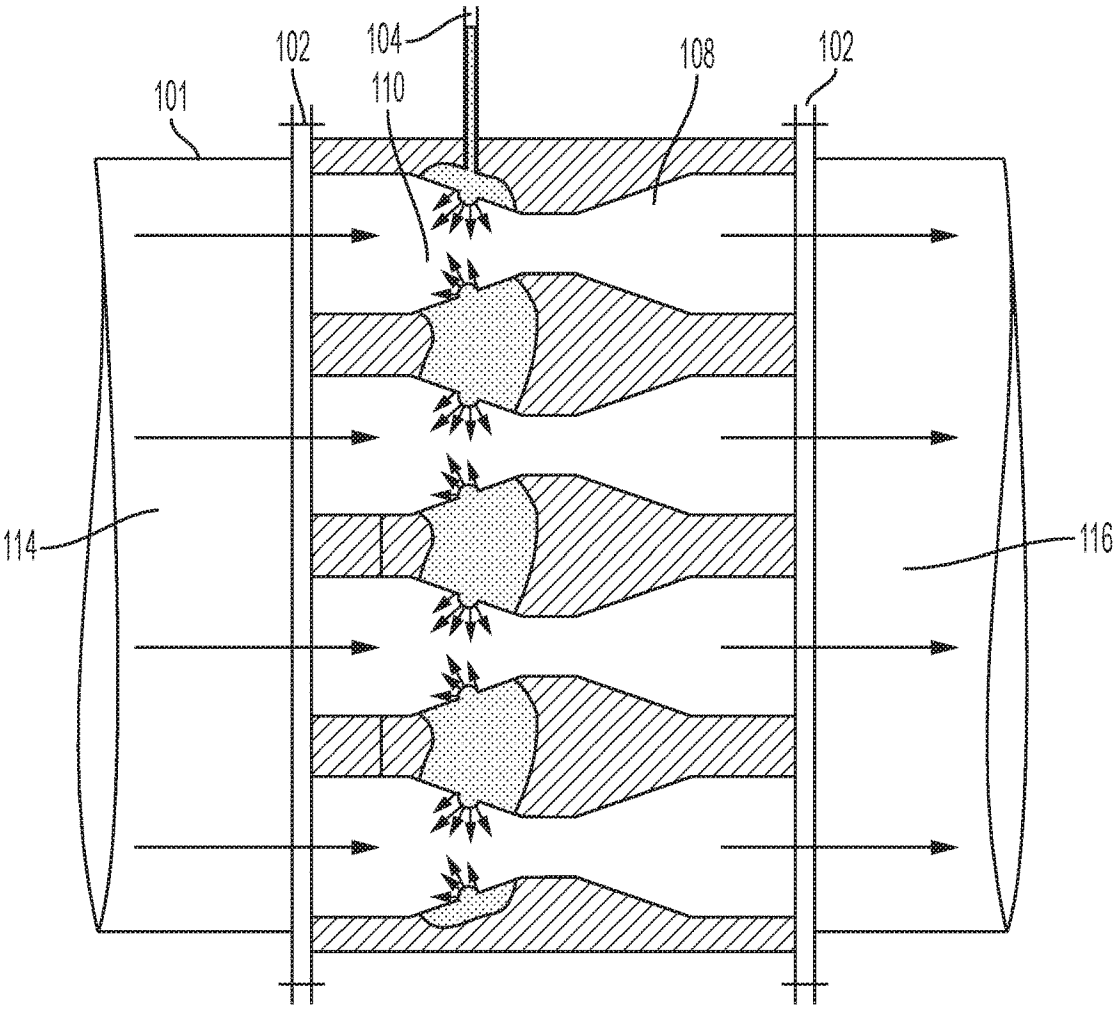

As show in FIGS. 5A and 5B, in some embodiments, the fluid mixing device may not include an adjustable self-opening valve. In some embodiments, for example, as shown in FIG. 5A, a fluid mixing device may have a larger diameter than the conduit or pipe 101.

Figure 6B:
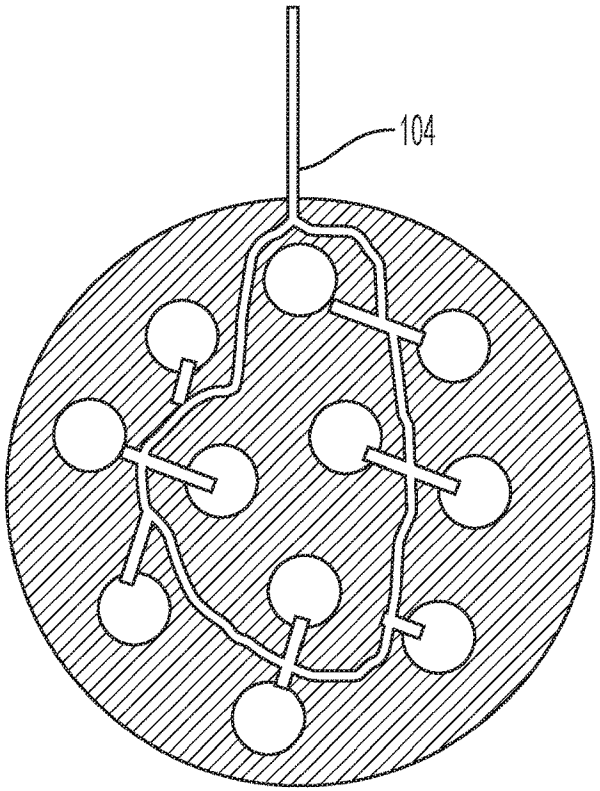
FIGS. 6A and 6B are schematic representations of an injection apparatus comprising a plurality of orifices without an adjustable valve.
Figure 6A:
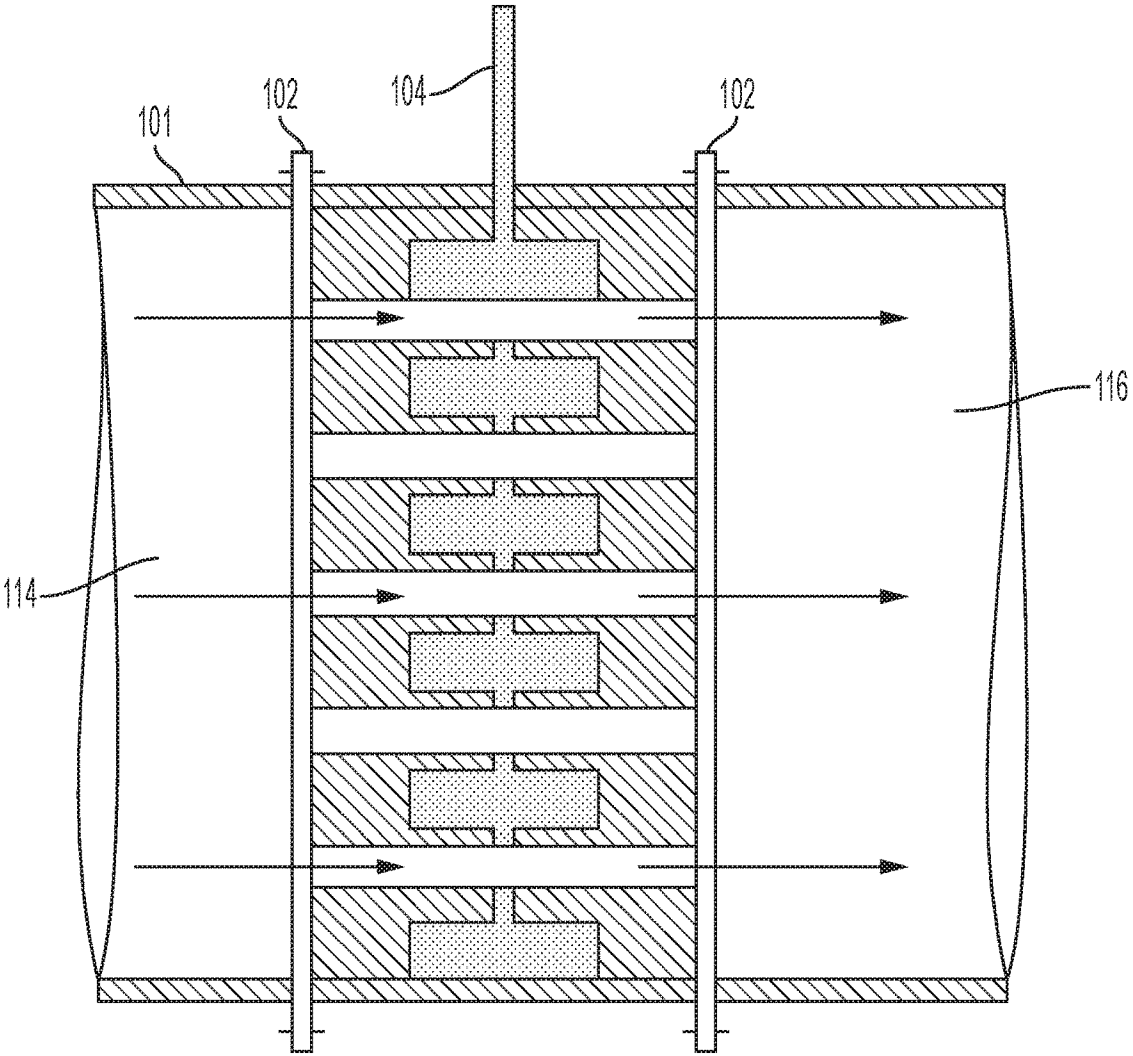

As shown in FIGS. 6A and 6B, in some embodiments, the fluid mixing device may not include an adjustable self-opening valve and may not include a converging chamber and/or a diverging chamber (for example, a chamber having a constant diameter). In some embodiments, for example, as shown in FIG. 6A, a fluid mixing device may have a smaller diameter than the conduit or pipe 101.

What claimed is:

1. A fluid mixing device comprising a plurality of nozzles connected to an inlet port for receiving a fluid and directing the fluid to the plurality of nozzles, and connected to an outlet port, wherein each of the plurality of nozzles has a longitudinal axis substantially parallel to a main direction of fluid flow and each of the plurality of nozzles comprises:

a converging chamber comprising an inflow portion for receiving fluid from the inlet port and an outflow portion, a diameter of the inflow portion being greater than a diameter of the outflow portion, the converging chamber comprising a substantially frusto-conical shape;

at least one chemical injection port connected to the outflow portion of the converging chamber, and each adapted for delivering a chemical agent to the converging chamber, a diverging chamber comprising an inflow portion and an outflow portion, a diameter of the inflow portion of the diverging chamber being smaller than a diameter of an outflow portion of the diverging chamber, the diverging chamber comprising a substantially frusto-conical shape;

a nozzle throat in fluid connection with the outflow portion of the converging chamber and the inflow portion of diverging chamber, the nozzle throat having a diameter that is smaller than any other portion of the nozzle; and an adjustable self-opening valve disposed in the diverging chamber and adapted such that when a pressure across a surface of the adjustable self-opening valve substantially perpendicular to each axis is higher than a predetermined value, the adjustable self-opening valve opens, wherein each of the plurality of nozzles is adapted such that flowing the fluid through the mixing device produces a homogenous mixture of the fluid and the chemical agent in the diverging chamber.

2. The fluid mixing device of claim 1, wherein the adjustable self-opening valve comprises an elastomer or a diaphragm.

3. The fluid mixing device of claim 1, wherein the fluid mixing device comprises two, three, four, five, six, seven, eight, nine, or ten nozzles.

4. The fluid mixing device of claim 1, wherein the fluid is selected from the group consisting of crude oil, water, gas, formation fluids, glycol, and combinations thereof.

5. The fluid mixing device of claim 1, wherein the chemical agent is selected from the group consisting of a demulsifier, scale inhibitor, corrosion inhibitor, oxygen scavenger, biocide, antifoaming agent, drag reducing agent, hydrate inhibitor, hydrogen sulfide scavenger, mercaptan scavenger, paraffin control agent, pour point depressant, asphaltene control agent, and combinations thereof.

6. The fluid mixing device of claim 1, wherein the adjustable self-opening valve does not comprise an external control mechanism, and wherein the adjustable self-opening valve remains partially open when exposed to atmospheric pressure.

7. The fluid mixing device of claim 1, wherein a pressure differential along the longitudinal axis of the converging chamber is within a range of 3 kPa to 700 kPa.

8. The fluid mixing device of claim 1, wherein a pressure differential along the longitudinal axis of the diverging chamber is within a range of 3 kPa to 700 kPa.

9. The fluid mixing device of claim 1, wherein the converging chamber is adapted to increase a velocity of the fluid wherein the fluid mixing device achieves consistent mixing at turndown ratios between 25% and 100%.

10. The fluid mixing device of claim 1, wherein the diverging chamber is adapted to decrease the velocity of the fluid wherein the fluid mixing device achieves consistent mixing at chemical agent volumetric flow rates from 1% to 20% of the fluid flow through the fluid mixing device.

11. The fluid mixing device of claim 1, wherein the predetermined value is within a range of 1.0 kPa to 100 kPa.

12. The fluid mixing device of claim 1, wherein the axes of the plurality of nozzles are parallel to each other.

13. The fluid mixing device of claim 1, wherein the plurality of the nozzles are radially off-set about a longitudinal axis of the device at a regular angular interval.

14. The fluid mixing device of claim 13, wherein the regular angular interval is about 15, 30, 45, 60, 90, 120, 135, 150, or 180 degrees.

15. The fluid mixing device of claim 1, wherein the plurality of the nozzles are randomly distributed within the fluid mixing device across a plane perpendicular to the axes.

16. The fluid mixing device of claim 1, wherein the at least one chemical injection port of each of the plurality of the nozzles are each fluidly connected to at least one chemical agent tank.

17. The fluid mixing device of claim 1, wherein the fluid flow in the converging chamber is turbulent or laminar.

18. The fluid mixing device of claim 1, wherein the fluid mixing device is disposed between a pair of flanges inside a pipe, wherein the inlet port is connected to the plurality of nozzles such that the flow is distributed between the individual nozzles, and wherein the outlet port is connected to the plurality of nozzles such that the flow streams out of the individual nozzles are joined.

19. The fluid mixing device of claim 18, wherein the fluid is incompressible, and wherein the flow rate through each nozzle of the plurality of nozzles is different from the flow rates of every other nozzle of the plurality of nozzles.

20. The fluid mixing device of claim 1, wherein a flow rate at the outlet port is substantially constant when the adjustable self-opening valves are open.

* * * * *